US011208803B2

(12) United States Patent
Pagan

(10) Patent No.: US 11,208,803 B2
(45) Date of Patent: Dec. 28, 2021

(54) EXTRUDED INSULATED CONCRETE FORM BLOCK SYSTEM WITH CORNER, TOP AND BOTTOM BLOCKS

(71) Applicant: Juan Bautista Rodriguez Pagan, San Juan, PR (US)

(72) Inventor: Juan Bautista Rodriguez Pagan, San Juan, PR (US)

( * ) Notice: Subject to any disclaimer, the term of this patent is extended or adjusted under 35 U.S.C. 154(b) by 0 days.

(21) Appl. No.: 16/734,184

(22) Filed: Jan. 3, 2020

(65) Prior Publication Data

US 2021/0207369 A1 Jul. 8, 2021

(51) Int. Cl.

| | |
|---|---|
| ***E04B 2/52*** | (2006.01) |
| ***E04B 1/04*** | (2006.01) |
| ***E04B 2/46*** | (2006.01) |
| ***E04B 1/21*** | (2006.01) |
| ***E04B 2/02*** | (2006.01) |

(52) U.S. Cl.

CPC ..... *E04B 2/52* (2013.01); *E04B 1/043* (2013.01); *E04B 1/21* (2013.01); *E04B 2/46* (2013.01); *E04B 2002/0215* (2013.01)

(58) Field of Classification Search

CPC ... E04B 2/52; E04B 1/043; E04B 1/21; E04B 2/46; E04B 2002/0206; E04B 2/48; E04B 2002/0247; E04B 2002/0215

See application file for complete search history.

(56) References Cited

U.S. PATENT DOCUMENTS

| | | | | | |
|---|---|---|---|---|---|
| 3,475,873 | A * | 11/1969 | Steadman | E04B 2/42 | 52/293.1 |
| 3,529,390 | A * | 9/1970 | Grant | E04B 2/18 | 52/285.1 |
| 3,782,049 | A * | 1/1974 | Sachs | E04B 2/26 | 52/309.9 |
| 3,895,148 | A * | 7/1975 | Chang | A63H 33/084 | 428/81 |
| 4,075,808 | A * | 2/1978 | Pearlman | E04B 2/54 | 52/439 |
| 4,439,967 | A * | 4/1984 | Dielenberg | E04B 2/26 | 52/309.12 |
| 4,475,326 | A * | 10/1984 | Hanson | A63H 33/084 | 52/286 |
| 4,894,969 | A * | 1/1990 | Horobin | E04B 2/26 | 52/309.12 |

(Continued)

FOREIGN PATENT DOCUMENTS

WO WO-2013078732 A1 * 6/2013 ..... E04B 2/50

*Primary Examiner* — Theodore V Adamos

(74) *Attorney, Agent, or Firm* — Lyman Moulton, Esq.; Moulton Patents, PLLC

(57) ABSTRACT

An insulated concrete form (ICF) system includes a rectangular building block formed of two back to back half beam "C" sections defining a half beam space at each open end of the "ƆC" block and defining an intersecting column space orthogonal thereto with interlocking grooves on each corner side of the block. The system also includes a plurality of rectangular building blocks interlocked via the interlocking grooves configured to form a grid of beam space and intersecting column space orthogonal thereto, the resulting grid space configured to be filled with concrete and interstitial rebar to form a concrete wall.

14 Claims, 9 Drawing Sheets

(56) References Cited

U.S. PATENT DOCUMENTS

| | | | | | |
|---|---|---|---|---|---|
| 5,014,480 | A * | 5/1991 | Guarriello | B28B 7/348 | 52/309.12 |
| 5,086,600 | A * | 2/1992 | Holland | E04B 2/26 | 52/309.12 |
| 5,191,744 | A * | 3/1993 | Bowes | E04B 2/42 | 52/564 |
| 5,839,243 | A * | 11/1998 | Martin | E04B 2/8629 | 52/439 |
| 7,818,938 | B2 * | 10/2010 | Lemieux | E04B 2/16 | 52/564 |
| 8,133,337 | B2 * | 3/2012 | Dardanis | B28B 3/021 | 156/71 |
| 9,086,268 | B2 * | 7/2015 | Jones | G01B 5/14 | |
| 10,190,313 | B1 * | 1/2019 | Toledo | E04B 2/54 | |
| 10,865,560 | B1 * | 12/2020 | Morrow | E04B 2/16 | |
| 2007/0245660 | A1 * | 10/2007 | Scott | E04B 2/10 | 52/438 |
| 2008/0066408 | A1 * | 3/2008 | Hileman | E04B 2/8647 | 52/414 |
| 2014/0150361 | A1 * | 6/2014 | Castonguay | E04C 1/40 | 52/309.4 |

* cited by examiner

Main block

Bottom block

Middle block

Top block

Corner block

Top View Front View Orthogonal View

Main Corner block

Top View

Front View

Side View

Orthogonal View

Top Corner block

Top View

Front View

Side View

Orthogonal View

Bottom Corner block

EXTRUDED INSULATED CONCRETE FORM BLOCK SYSTEM WITH CORNER, TOP AND BOTTOM BLOCKS

BACKGROUND OF THE INVENTION

Insulating concrete form or insulated concrete form (ICF) is a system of formwork for reinforced concrete usually made with a rigid thermal insulation that stays in place as a permanent interior and exterior substrate for walls, floors, and roofs. The forms are interlocking modular units that are dry-stacked (without mortar) and filled with concrete. The units lock together somewhat like Lego bricks and create a form for the structural walls or floors of a building. ICF construction has become commonplace for both low rise commercial and high performance residential construction as more stringent energy efficiency and natural disaster resistant building codes are adopted. ICFs may be used with frost protected shallow foundations (FPSF), the originator of which was the Swedish company Legalett. The first Legalett slab was designed and built in Kungälv, Sweden in 1983 and even had a rudimentary warm air heating system in pipes cast into the concrete slab.

The first expanded polystyrene ICF Wall forms were developed in the late 1960s with the expiration of the original patent and the advent of modern foam plastics by BASF. Canadian contractor Werner Gregori filed the first patent for a foam concrete form in 1966 with a block "measuring 16 inches high by 48 inches long with a tongue-and-groove interlock, metal ties, and a waffle-grid core." It is right to point out that a primordial form of ICF formwork dates back to 1907, as evidenced by the patent entitled "building-block", inventor L. R. Franklin. This patent claimed a parallelepiped-shaped brick having a central cylindrical cavity, connected to the upper and lower faces by countersink.

The adoption of ICF construction has steadily increased since the 1970s, though it was initially hampered by lack of awareness, building codes, and confusion caused by many different manufacturers selling slightly different ICF designs rather than focusing on industry standardization. ICF construction is now part of most building codes and accepted in most jurisdictions in the developed world.

SUMMARY OF THE INVENTION

An insulated concrete form (ICF) system includes a rectangular building block formed of two back to back half beam "C" sections defining a half beam space at each open end of the "ↃC" and defining an intersecting column space orthogonal thereto with interlocking grooves on each corner side of the block. The system also includes a plurality of rectangular building blocks interlocked via the interlocking grooves configured to form a grid of beam space and intersecting column space orthogonal thereto, the resulting grid space configured to be filled with concrete and interstitial rebar to form a concrete wall.

A method of building the Insulated Concrete Form (ICF) wall includes forming a rectangular building block of two back to back half beam "C" sections defining a half beam space at each open end of the "ↃCC" and defining an intersecting column space orthogonal thereto with interlocking grooves on each corner side of the block. The method also involves interlocking a plurality of rectangular building blocks via the interlocking grooves configured to form a grid of beam space and intersecting column space orthogonal thereto, the resulting grid space configured to be filled with concrete and interstitial rebar to form a concrete wall.

Other aspects and advantages of embodiments of the disclosure will become apparent from the following detailed description, taken in conjunction with the accompanying drawings, illustrated by way of example of the principles of the disclosure.

Figure 1:
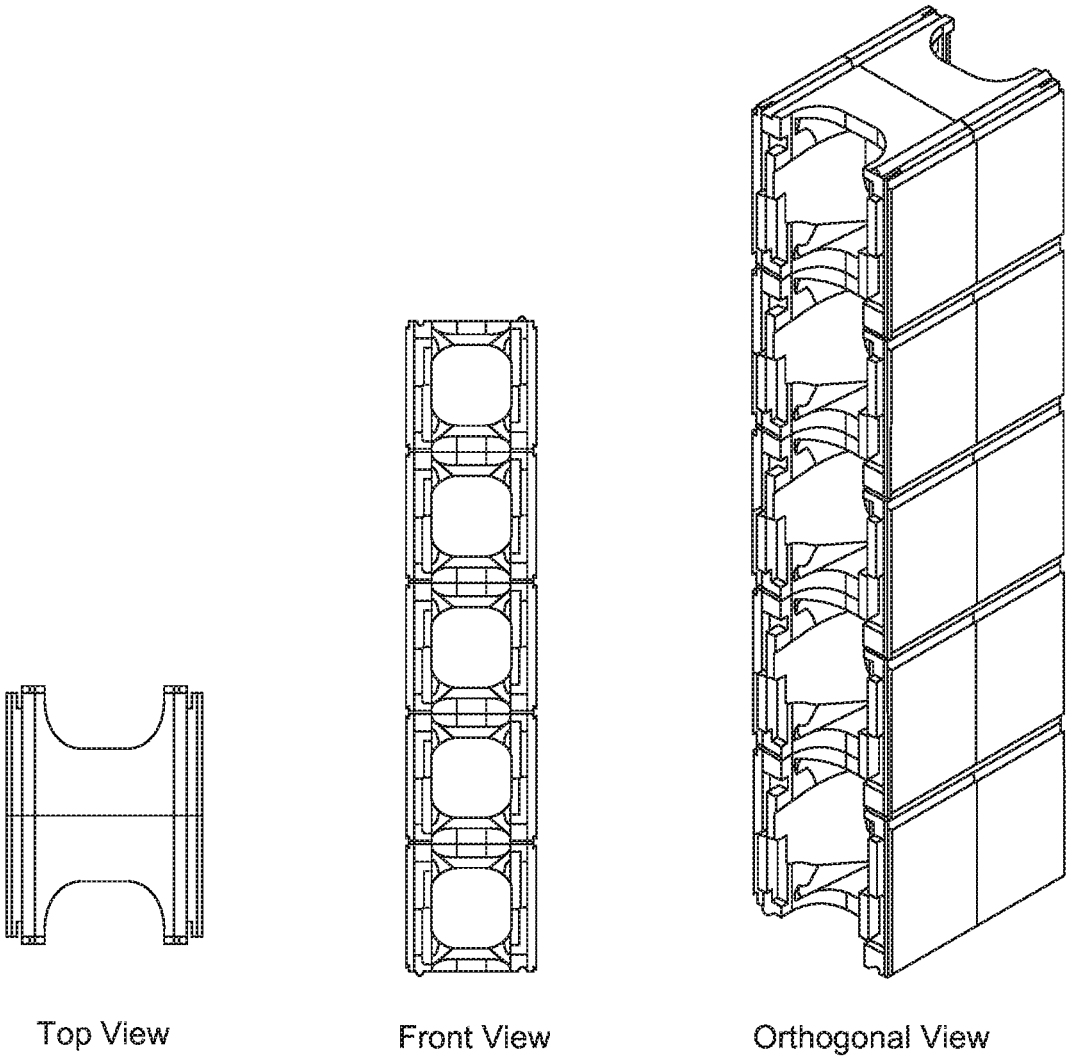
FIG. 1 illustrates a top, front and orthogonal view of a main block in accordance with an embodiment of the disclosure.

Throughout the description, similar or same reference numbers may be used to identify similar or same elements in the several embodiments and drawings. Although specific embodiments of the invention have been illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

The terms column and beam are used interchangeably in reference to a grid formed there from. In other words, a column in the denotative sense as an upright member may also be used herein in a connotative sense to refer to an interseting member with a beam and vice versa.

The disclosed insulated concrete form design does not use plastic or metal ties, instead the EPS (expanded polystyrene) connection prevents the two sides of the wall from moving independently; avoiding bulges and blowouts along the wall and corners. The disclosed ICF (insulated concrete form)

design also reduces the amount of bracing needed, and usually eliminates corner bracing. The disclosed foam concrete forms use BPS ties which are integral to the wall, and engineered to work as an arch works.

A grid of concrete is created around the rebar, allowing the rebar to transfer strength throughout the wall with optimum efficiency. The interlocked column and beam design allows the structure the ability to flex under severe seismic loads, and maintain its integrity without structural damage. The EPS ties absorb some of the daily and seasonal expansion and contraction, enough to help eliminate the concrete cracking associated with solid concrete.

The disclosed engineering has created an ICF building system that can be poured in single lifts to 10 ft or 12 ft high. Blowouts are not a concern, walls are straight, plumb, and flat when stacked, and stay that way during the pour. The pour is done with minimal bracing which is required primarily for wind and safety concerns.

The disclosure provides engineered and International Residential Code approval. The strength paired with reduced concrete cost is a measureable benefit. A typical 40×50 square feet basement will use about $50 extra rebar, and reduce concrete costs about $1,500, a significant savings of $1,450. Labor on concrete walls and foundations via the disclosure is estimated at about half of other concrete wall and foundation installations.

The disclosure's competitive advantage is that our insulating concrete forms build strong, straight, and flat concrete walls requiring less labor, reduced concrete, and reduced bracing. The disclosure is a tough block to beat, with the lowest installed cost of any ICI' on the market today.

FIG. 1 illustrates a top, front and orthogonal view of a main block in accordance with an embodiment of the disclosure. The top view is of a single block. The front view includes 5 interlocked blocks. The orthogonal view also includes 5 interlocked blocks.

Figure 2:
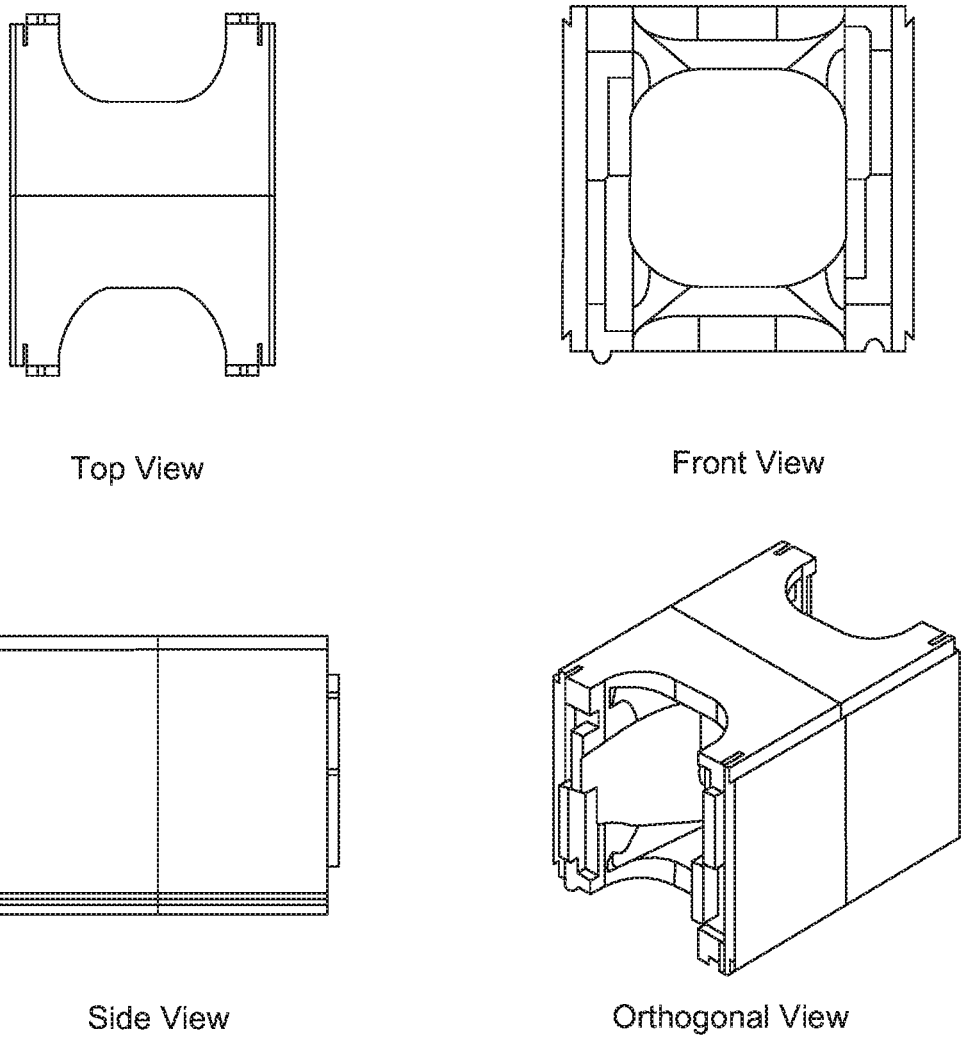
FIG. 2 illustrates a top, front and orthogonal view of a bottom block in accordance with an embodiment of the disclosure.

FIG. 2 illustrates a top, front and orthogonal view of a bottom block in accordance with an embodiment of the disclosure. The top view is of a single block. The front view includes 5 interlocked blocks. The orthogonal view also includes 5 interlocked blocks.

Figure 3:
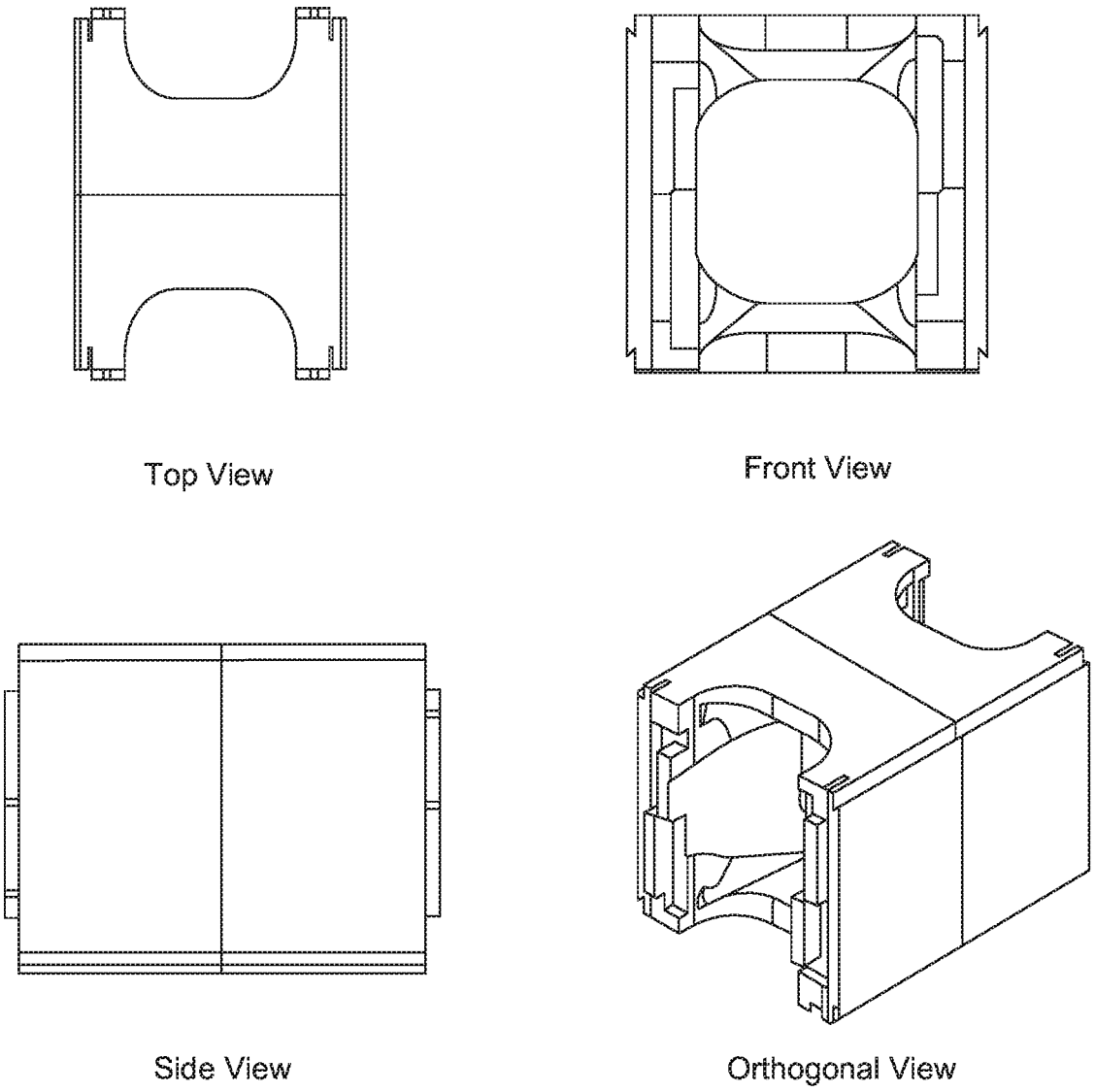
FIG. 3 illustrates top, front and orthogonal view of a a middle block in accordance with an embodiment of the disclosure.

FIG. 3 illustrates top, front and orthogonal view of a a middle block in accordance with an embodiment of the disclosure. The top view is of a single block. The front view includes 5 interlocked blocks. The orthogonal view also includes 5 interlocked blocks.

Figure 4:
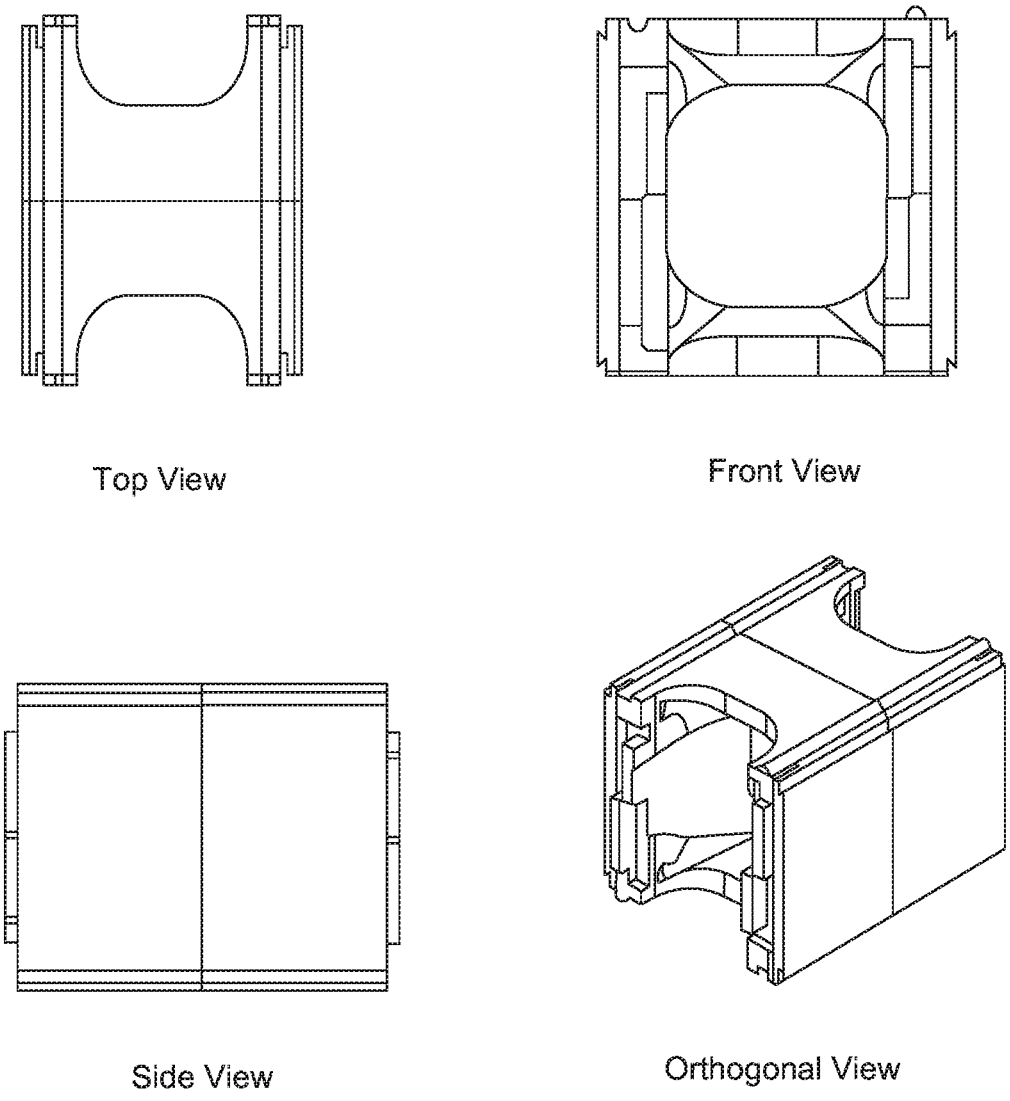
FIG. 4 illustrates a top, front and orthogonal view of a top block in accordance with an embodiment of the disclosure.

FIG. 4 illustrates a top, front and orthogonal view of a top block in accordance with an embodiment of the disclosure. The top view is of a single block. The front view includes 5 interlocked blocks. The orthogonal view also includes 5 interlocked blocks.

Figure 5:
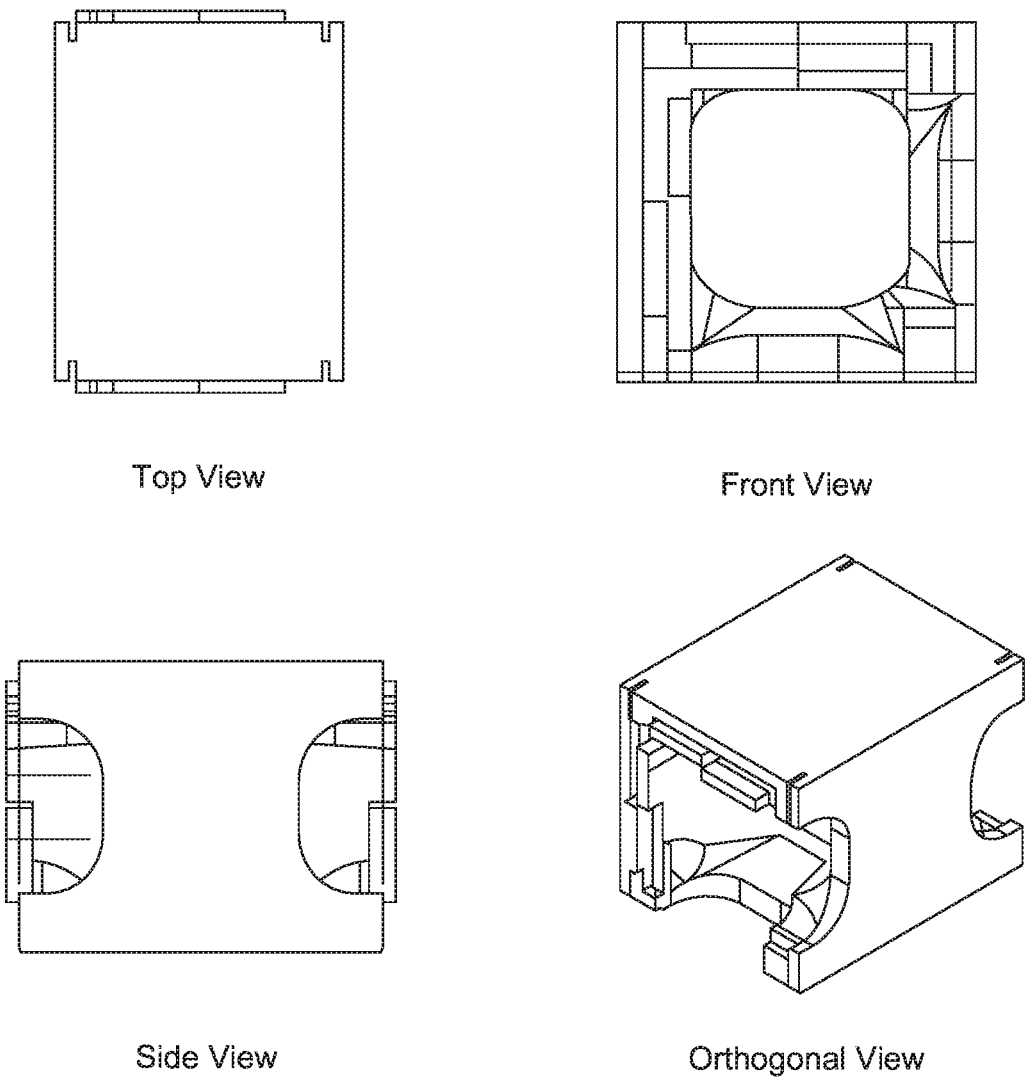
FIG. 5 illustrates a top, front and orthogonal view of a corner block in accordance with an embodiment of the disclosure.

FIG. 5 illustrates a top, front and orthogonal view of a corner block in accordance with an embodiment of the disclosure. The top view is of a single block. The front view includes 5 interlocked blocks. The orthogonal view also includes 5 interlocked blocks.

Figure 6:
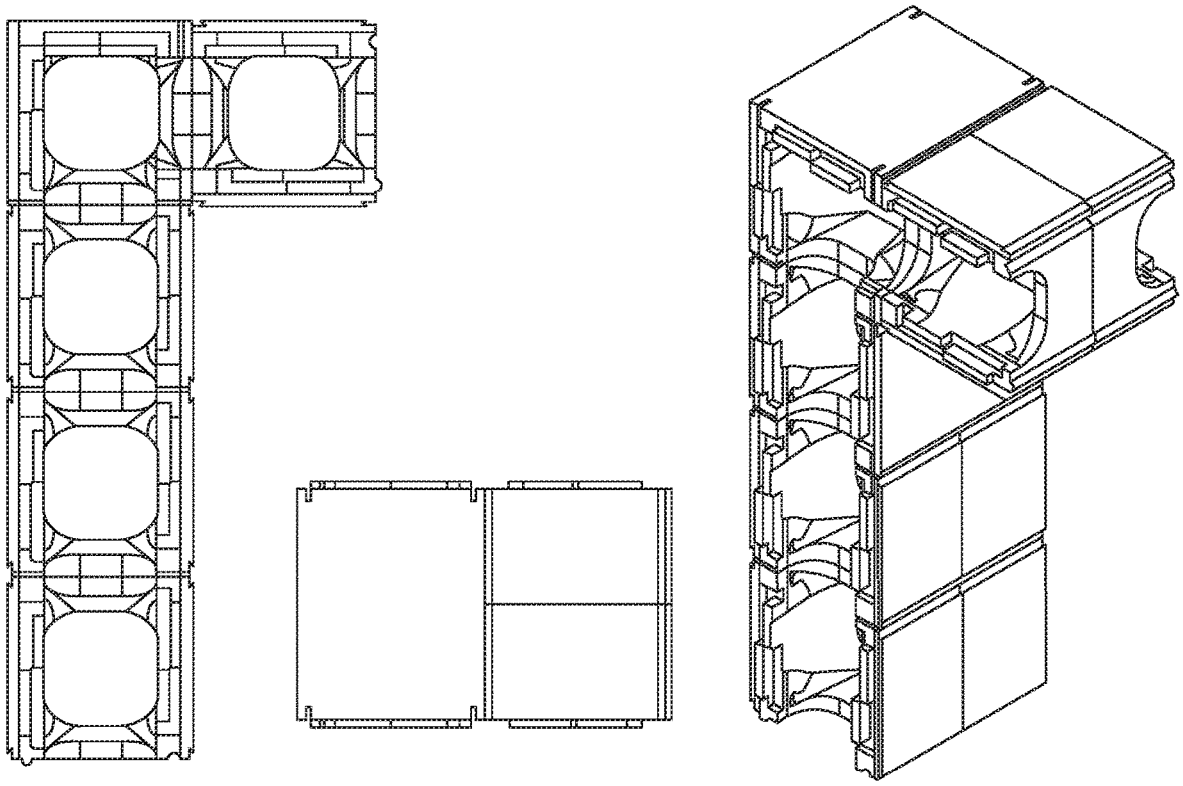
FIG. 6 illustrates a top, front and orthogonal view of a main corner block in accordance with an embodiment of the disclosure.

FIG. 6 illustrates a top, front and orthogonal view of a main corner block in accordance with an embodiment of the disclosure. The top view is of a single block. The front view includes 5 interlocked blocks. The orthogonal view also includes 5 interlocked blocks.

Figure 7:
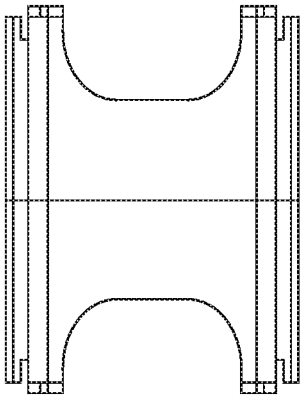
FIG. 7 illustrates a top, front and orthogonal view of a top corner block in accordance with an embodiment of the disclosure.
Figure 7:
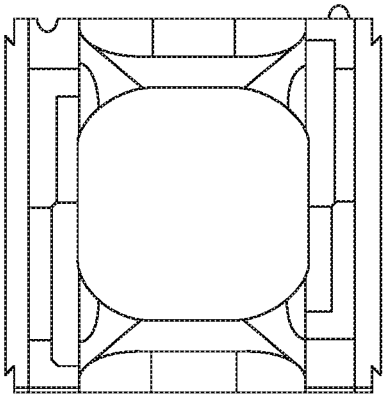
Figure 7:
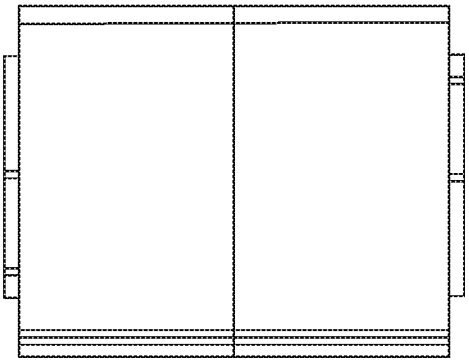
Figure 7:
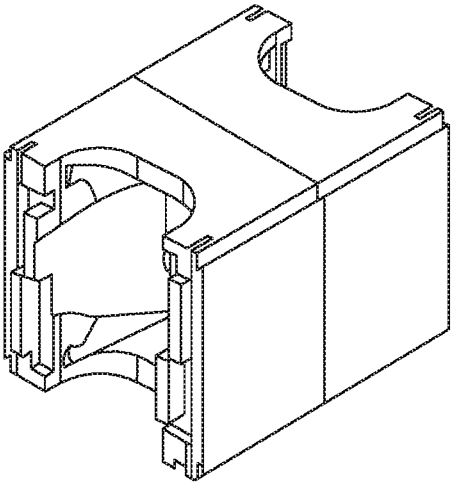

FIG. 7 illustrates a top, front and orthogonal view of a top corner block in accordance with an embodiment of the disclosure. The top view is of a single block. The front view includes 5 interlocked blocks. The orthogonal view also includes 5 interlocked blocks.

Figure 8:
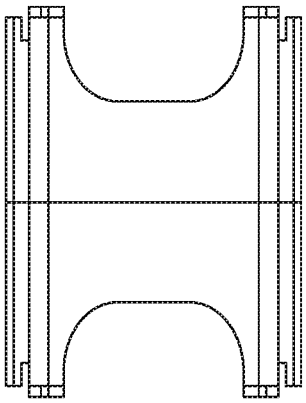
FIG. 8 illustrates a top, front and orthogonal view of a bottom corner block in accordance with an embodiment of the disclosure.
Figure 8:
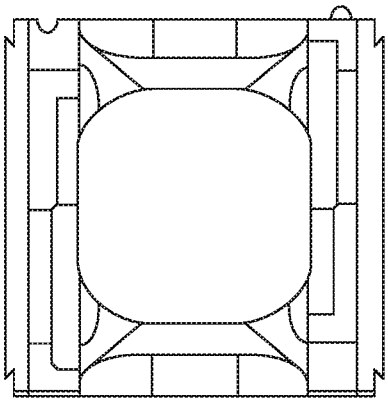
Figure 8:
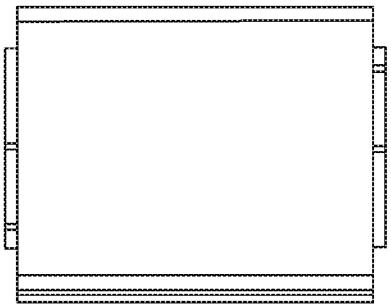
Figure 8:
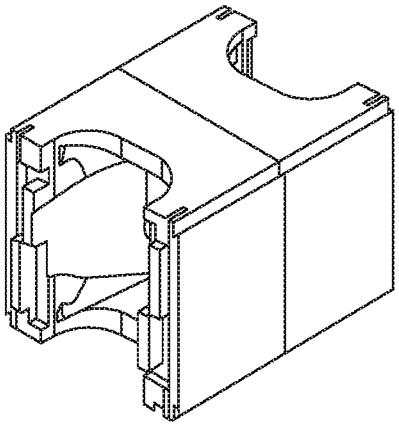

FIG. 8 illustrates a top, front and orthogonal view of a bottom corner block in accordance with an embodiment of the disclosure. The top view is of a single block. The front view includes 5 interlocked blocks. The orthogonal view also includes 5 interlocked blocks.

Figure 9:
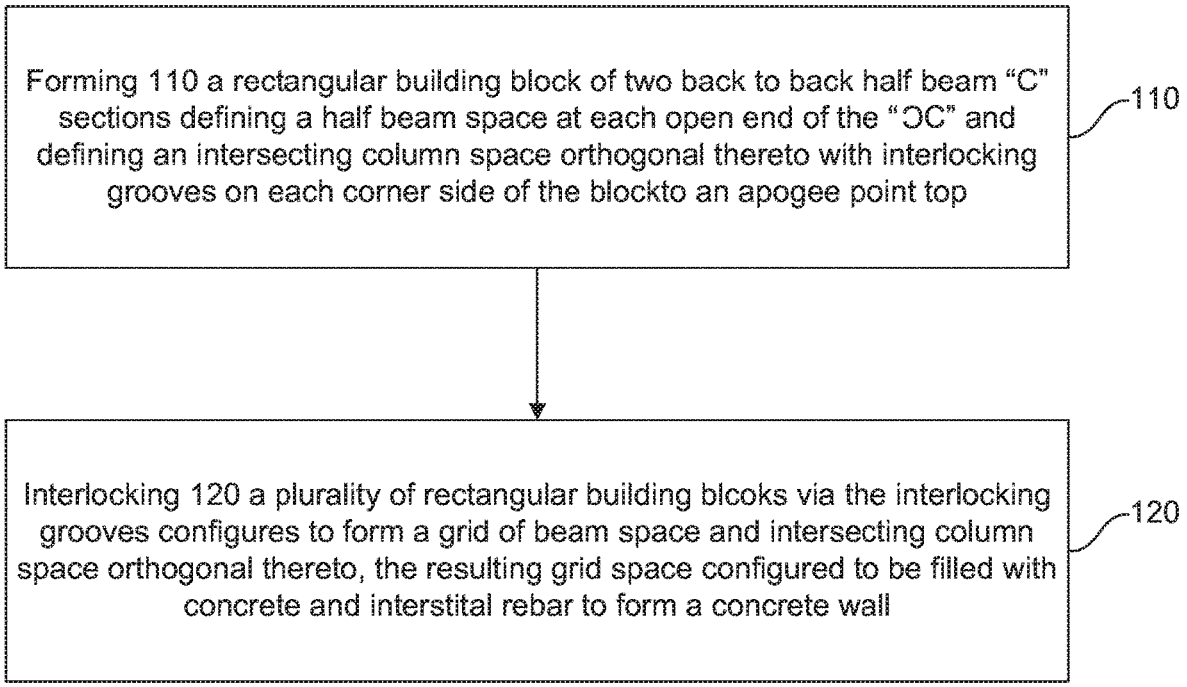
FIG. 9 depicts a flow chart of a method for building an ICF wall in accordance with an embodiment of the disclosure.

FIG. 9 depicts a flow chart of a method for building an ICF wall in accordance with an embodiment of the disclosure. The method of building the Insulated Concrete Form (ICF) wall includes forming 110 a rectangular building block of two back to back half beam "C" sections defining a half beam space at each open end of the "ↃC C" and defining an intersecting column space orthogonal thereto with interlocking grooves on each corner side of the block. The method also involves interlocking 120 a plurality of rectangular building blocks via the interlocking grooves configured to form a grid of beam space and intersecting column space orthogonal thereto, the resulting grid space configured to be filled with concrete and interstitial rebar to form a concrete wall.

This application discloses a new ICF block produced from a unique polymer foam that is continuously extruded into a monolithic profile. This polymer foam material is not like structural foam injection molding or EPS (Expanding Poly-Styrene) bead foam molding. The extruded foam ICF block has a closed cell structure with shared common walls between adjacent cells. This is different than separate individual cell walls being in contact with numerous other separate adjacent cell walls as in EPS bead molding.

As the ICF block exits the extruder, it is cut into uniform lengths or blanks. After which these blanks are machined to create the finished product, openings on the bottom, openings on the side and other details resulting in a mono block or monolithic block produced from a single, unitary extrusion blank. Like the bottom, the top and sides also have holes or openings machined for various reasons or functions including grooves.

In an embodiment, a blowing agent or blowing a gas into a continuously extruding polymer produces the disclosed ICF block having a cross section across any two material points thereof defining a plurality of random and gas filled closed mini cells sharing walls between adjacent cells.

Although the components herein are shown and described in a particular order, the order thereof may be altered so that certain advantages or characteristics may be optimized. In another embodiment, instructions or sub-operations of distinct steps may be implemented in an intermittent and/or alternating manner.

Notwithstanding specific embodiments of the invention have been described and illustrated, the invention is not to be limited to the specific forms or arrangements of parts so described and illustrated. The scope of the invention is to be defined by the claims and their equivalents.

What is claimed is:

1. An insulated concrete form (ICF) system comprising:

a plurality of rectangular building blocks each formed of two back to back half beam "C" sections defining a half beam space at each open longitudinal end of the "ↃC" block and defining an intersecting column space orthogonal thereto with slits and interlocking vertically and horizontally offset rectangular protrusions and grooves formed on each corner side of the longitudinal ends of each building block, wherein the plurality of rectangular building blocks are interlocked via aligning the slits of adjacent building blocks and interlocking the vertically and horizontally offset rectangular protrusions and grooves of adjacent building blocks, the interlocked building blocks configured to form a grid of beam space and intersecting column space orthogonal thereto, the resulting grid configured to be filled with concrete and interstitial rebar to form a concrete wall.

2. The ICF of claim 1, further comprising a top block configured to form half of a concrete beam adjacent a top of the concrete wall.

3. The ICF of claim 1, further comprising a bottom block configured to form half a concrete beam adjacent a foundation.

4. The ICF of claim 1, further comprising a middle block configured to form a full column and two each half beams intersecting the full column at 180 degree angles to each other.

5. The ICF of claim 1, further comprising a top corner block configured to form a corner column and two each half beams at ninety degree angles to each other adjacent a top of the concrete wall.

6. The ICF of claim 1, further comprising a bottom corner block configured to form a corner column and two each half beams at ninety degree angles to each other adjacent a foundation.

7. The ICF of claim 1, further comprising a main corner block comprising one of the plurality of blocks and a corner forming an "L" shaped block having inner corner sides at ninety degree angles to each other.

8. The ICF of claim 1, further comprising a corner block configured to close the beam space via two inner sides disposed adjacent and at ninety degree angles to each other.

9. The ICF of claim 1, further comprising a plurality of interstitial EPS (expanded polystyrene) strips running parallel with the beam space.

10. An Insulated Concrete Form (ICF) system comprising:

a plurality of rectangular building blocks each formed of two back to back half column "C" sections defining a half column space at each open longitudinal end of the "ↃC" block and defining an intersecting beam space orthogonal thereto with slits and interlocking vertically and horizontally offset rectangular protrusions and grooves formed on each corner side of the longitudinal ends of each building block, wherein the plurality of rectangular building blocks are interlocked via aligning the slits of adjacent building blocks and interlocking the vertically and horizontally offset rectangular protrusions and grooves of adjacent building blocks, the interlocked building blocks configured to form a grid of beam space and intersecting column space orthogonal thereto, the resulting grid configured to be filled with concrete and interstitial rebar to form a concrete wall.

11. The ICF of claim 10, further comprising a middle block configured to form a full beam and two each half columns intersecting the full beam at 180 degree angles to each other.

12. The ICF of claim 10, further comprising a main corner block comprising one of the plurality of blocks and a corner block forming an "L" shaped block having two inner sides adjacent and at ninety degree angles to each other.

13. The ICF of claim 10, further comprising a plurality of interstitial EPS (expanded polystyrene) strips running parallel with the column space.

14. A method of building an Insulated Concrete Form (ICF) wall, the method comprising:

forming a plurality of rectangular building blocks each of two back to back half beam "C" sections defining a half beam space at each open longitudinal end of the "ↃC" block and defining an intersecting column space orthogonal thereto with slits and interlocking vertically and horizontally offset rectangular protrusions and grooves formed on each corner side of the longitudinal ends of each building block; and interlocking the plurality of rectangular building blocks via aligning the slits of adjacent building blocks and interlocking the vertically and horizontally offset rectangular protrusions and grooves of adjacent building blocks, the interlocked building blocks configured to form a grid of beam space and intersecting column space orthogonal thereto, the resulting grid configured to be filled with concrete and interstitial rebar to form a concrete wall.

* * * * *